United States Patent [19]

Palmerino

[11] 4,083,589

[45] Apr. 11, 1978

[54] VEHICLE SECURITY SYSTEM

[76] Inventor: Henry Palmerino, The Trail, Sturbridge, Mass. 01566

[21] Appl. No.: 785,684

[22] Filed: Apr. 7, 1977

[51] Int. Cl.[2] ..... E05C 21/00

[52] U.S. Cl. ..... 292/336.3; 292/DIG. 37

[58] Field of Search ..... 292/170, 174, 336.3, 292/347, 1, DIG. 37

[56] References Cited

U.S. PATENT DOCUMENTS

| | | | |
|---|---|---|---|
| 1,257,998 | 3/1918 | Gruber | 292/174 X |
| 1,395,527 | 11/1921 | Sheehan et al. | 292/174 X |
| 2,207,568 | 7/1940 | Wild | 292/174 X |
| 3,428,350 | 2/1969 | Trammell, Jr. | 292/336.3 |

*Primary Examiner*—Richard E. Moore

*Attorney, Agent, or Firm*—Norman S. Blodgett; Gerry A. Blodgett

[57] ABSTRACT

Security system having a first vertically-movable button and a second horizontally-movable button; a wedge is mounted on the second button to engage and move the first button.

6 Claims, 3 Drawing Figures

VEHICLE SECURITY SYSTEM

BACKGROUND OF THE INVENTION

In a conventional automobile, it is common practice to provide for locking and unlocking the door by providing a plunger or button that extends above the window sill. The button is connected to an interior mechanism in such a way that, when it is in its upper, raised position, the door is unlocked and, when it is in its lower, depressed position, the door is locked. In the lower position, the button extends slightly above the sill and its upper end is provided with an enlarged knob or protuberance to facilitate lifting the button with the fingers. Unfortunately, because of the fact that in the "lock" position the button extends above the sill a considerable distance and because of the fact that it is provided with this enlarged portion, it is possible for a thief to unlock the door by running a wire with a loop on its end over the top of the window and down to the button; the loop is dropped over the plunger, so that raising the wire lifts the plunger and unlocks the door. Attempts to remedy the deficiencies of this construction have been somewhat less than successful. For a number of reasons, they have been expensive to manufacture and install, either as original equipment or as a retro-fitted accessory. Some of them have been complicated and difficult to operate and, therefore, do not appeal to the ordinary automobile user. These and other difficulties experienced with the prior art devices have been obviated in a novel manner by the present invention.

It is, therefore, an outstanding object of the invention to provide an automotive security system which makes it difficult for a car thief to open a conventional automobile door.

Another object of this invention is the provision of an automotive security system which can be readily applied to an automobile during manufacture or applied to a used automobile.

A further object of the present invention is the provision of an automobile lock system which is simple in construction, which is inexpensive to manufacture, and which is capable of a long life of useful service with a minimum of maintenance.

It is another object of the instant invention to provide a lock security system for application to an automobile, which system can be applied to the automobile with a minimum structural change to the automobile and with little mechanic's labor.

With these and other objects in view, as will be apparent to those skilled in the art, the invention resides in the combination of parts set forth in the specification and covered by the claims appended hereto.

SUMMARY OF THE INVENTION

In general, the invention consists of a security system for an automobile having a door with a horizontal sill. A first button is slidably mounted in the door for vertical movement from an upper, unlocked position to a lower, locked position. A second button is slidably mounted in the door for horizontal movement from an outer inoperative position to an inner operative position. A wedge is mounted on the second button and provided with an inclined surface which engages the first button to move it from its lower to an upper position.

More specifically, in its lower position the first button does not extend above the surface of the sill. The upper end of the first button is substantially cylindrical and has no protuberance for engagement by a burglar tool. The lower end of the first button is threaded on a lock-operating rod and is provided with a semi-spherical surface for engagement by the inclined surface of the wedge.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
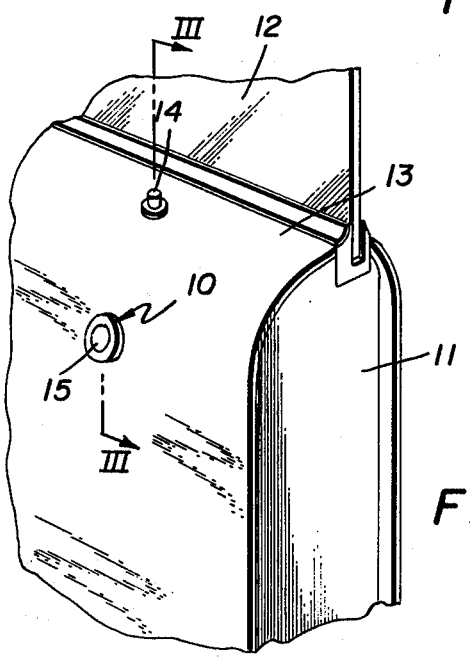
FIG. 1 is a perspective view of a security system embodying the principles of the present invention in use with an automobile door.

Referring first to FIG. 1, wherein are best shown the general features of the invention, the vehicle security system, indicated generally by the reference numeral 10, is shown in use with a right-hand front door 11 of an automobile. The upper part of the door is provided with a generally horizontal sill 13 from which extends upwardly a window 12. The portion of the security system which is visible in FIG. 1 includes a first button 14 located at the sill 13, and a second button 15 which is located on the inside verticle surface of the door substantially below the sill. The door 11 is shown as having the conventional equipment such as the window crank 16 and the arm rest 17 with the door latch actuator 20. The conventional latch 18 is located on the rear vertical edge of the door.

Figure 2:
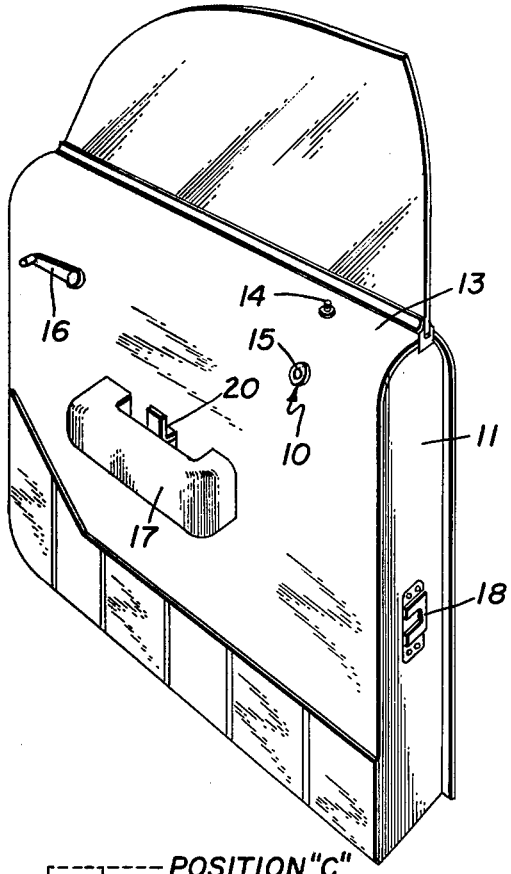
FIG. 2 is an enlarged perspective view of a portion of the door showing the security system in place.

FIG. 2 is an enlarged view of a portion of the door 11 which shows the details of the security system 10, including the relationship between the first button 14 extending above the sill 13 and the second button 15 located substantially below it. They lie in the same vertical plane with their axes at a right angle.

Figure 3:
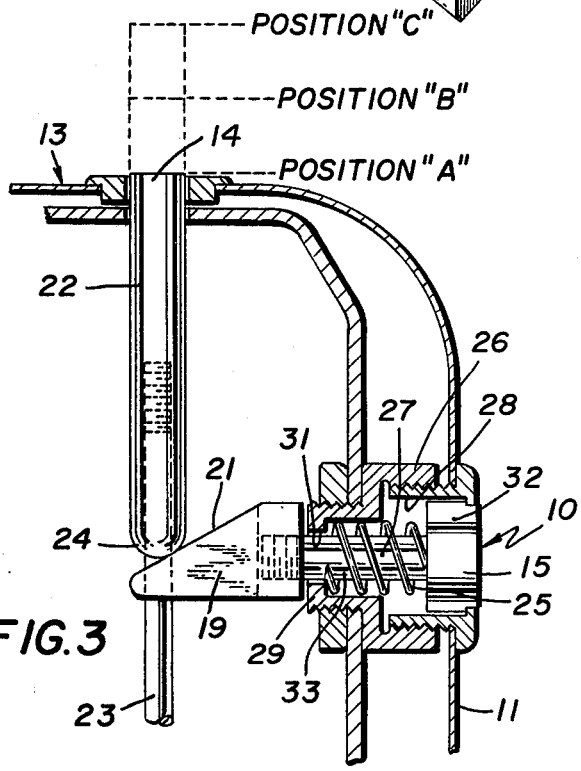
FIG. 3 is a vertical sectional view of the door taken on the line III—III of FIG. 2.

Referring next to FIG. 3, which is a sectional view through the door 11, it can be seen that the second button 15 is mounted for horizontal movement transversely of the door and is provided at its inner end with a wedge 19. The wedge has an inclined upper surface 21 which engages a spherical surface 24 on the lower end of the button 14. As is evident in this view, the first button 14 is provided with an elongated cylindrical surface without any enlargement or abutment at its upper end. A control rod 23 is threadedly connected to the lower end of the first button 14. The lower end of the rod 23 is connected to the latch 18 in the usual way selectively to allow or prevent the opening of the door with the regular exterior handle. The coil spring 25 serves to bias the second button 15 outwardly of the door (toward the inside of the car). The button 15 is carried in a generally hat-shaped housing or main body 26 which is fixed in apertures formed in the door panels. The button is provided with a plunger 27 having a stem 33 of reduced diameter. The plunger has at one end an enlarged head 32 which fits in a large bore 28 at the outer end of the main body 26. The main body 26 has a bottom formed with a smaller bore 31 in which the stem 33 resides. In other words, extending between the head 32 and the wedge 19 is the stem 33 which passes through the bore 31 in the main housing.

The operation and advantages of the invention will now be readily understood in view of the above description. The first button 14, when it is in its upper position "C" (shown in dots in FIG. 3), acts through the rod 23 to leave the latch 18 in "unlocked" positon. The door can then be opened by use of the usual door operating mechanism, including the door handle on the outside and the actuator 20 associated with the arm rest 17 on the inside. When the first button 14 is in an extreme lower position, "A", however, the rod 23 acts to prevent opening of the door. In other words, the door is "locked". The first button is selected of such a length that, when in the lower position, it is flush with the sill 13 of the door. In that condition it is impossible to raise it by lifting up on its upper end. As is evident in FIG. 3, the cylindrical surface 22 extends entirely to the upper end of the button and there is no protrusion or head to be grasped. It is impossible for a would-be thief, therefore, to insert the usual wire loop over the top of the window to operate the button. In order to move the button from its lower position "A" (where the door is locked) to its upper position "C" (where the door is unlocked), it is only necessary to push on the second button 15. When this is done, the head 32 moves inwardly carrying the stem 33 with it. This movement takes place against the compression force of the spring 25 and the wedge 19 moves laterally inwardly of the door. At that time the inclined surface 21 engages the spherical surface 22 on the bottom of the first button 14. It should be noted that the wedge 19 is bifurcated and consists of two halves which straddle the rod 23. The movement of the wedge 19 to the left (in FIG. 3) causes the first button 14 to move into an upper intermediate position "B" carrying the rod 23 upwardly a short distance, but not enough to unlock the latch. The first button 14 in the position "B" has sufficient exposed surface above the sill 13 to permit it to be grasped and raised even though it has no enlarged head. It is only necessary at that point to manually grasp the buttom 14 and lift it from the position "B" to the position "C", at which position the door latch is unlocked.

It can be seen that it is impossible to raise the first button 14 from the outside of the automobile; furthermore, the second button 15 cannot be actuated from the exterior either. Thus, the use of the present invention prevents the unauthorized opening of the automobile door and prevents access to the ignition and other equipment. Furthermore, it prevents access to the vehicle for the purpose of stealing radio equipment and the like, even if the thief does not choose to steal the vehicle. The system is relatively simple in construction and is readily adapted to the present locking system of a conventional automotive vehicle. It is particularly capable of being fitted to the automobile after manufacture by the use of simple tools and with relatively unskilled labor.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Security system for a vehicle having a door with a horizontal sill and a latch, comprising:

a. a first button slidably mounted in the door in operative relation to the said latch for vertical movement from an upper UNLOCK position above the sill where the latch is locked, to a lower LOCK position level with the sill where the latch is locked, b. a second button slidably mounted in the door for horizontal movement from an outer inoperative position to an inner operative position, and c. a wedge mounted on the second button and having an inclined surface that engages and moves the first button upwardly from its lower position to an upper position as the second button is moved inwardly from its inoperative position to its operative position.

2. Security system as recited in claim 1, wherein the upper end of the first button is flush with the sill when it is in its lower position.

3. Security system as recited in claim 1, wherein the upper end of the first button has a substantially cylindrical surface and has no protuberance for engagement by an unauthorized person.

4. Security system as recited in claim 1, wherein the lower end of the first button is threaded onto a lock-operating rod and is provided with a semi-spherical surface that is engaged by the inclined surface of the wedge.

5. Security system as recited in claim 1, wherein the second button is biased by a spring toward the outer position.

6. Security system as recited in claim 5, wherein the second button includes a main body fixed to the door and a plunger, wherein the main body having a large bore facing outwardly terminating in a bottom wall having a small bore extending therethrough, wherein the plunger has a head which slides in the large bore and a stem which slides in the small bore, and wherein the spring resides under compression between the head and the bottom wall.

* * * * *